US005119846A

United States Patent [19]

Tadrous et al.

[11] Patent Number: 5,119,846

[45] Date of Patent: Jun. 9, 1992

[54] HAIR WAVE ROLLERS

[76] Inventors: Nermine Tadrous; Nasser Diab, both of 700 S. Lewis La., Apt. 1106, Carbondale, Ill. 62901

[21] Appl. No.: 700,399

[22] Filed: May 15, 1991

[51] Int. Cl.[5] ..... A45D 2/40

[52] U.S. Cl. ..... 132/225; 132/223; 132/261

[58] Field of Search ..... 132/223, 224, 225, 226, 132/245, 251, 252, 253, 254, 261, 902

[56] References Cited

U.S. PATENT DOCUMENTS

| | | | |
|---|---|---|---|
| 1,892,575 | 12/1932 | Jacobs | 132/224 |
| 2,490,124 | 12/1949 | Gregory | 132/223 |
| 3,877,471 | 4/1975 | Boyd | 132/223 |
| 4,151,850 | 5/1979 | Nathe et al. | 132/225 |
| 4,261,375 | 4/1981 | Anderson | 132/224 |
| 4,739,776 | 4/1988 | Prijic | 132/224 |
| 4,867,185 | 9/1989 | Clingen | 132/224 |

FOREIGN PATENT DOCUMENTS

| | | | |
|---|---|---|---|
| 2632833 | 12/1989 | France | 132/225 |
| 2089657 | 6/1982 | United Kingdom | 132/223 |

*Primary Examiner*—John J. Wilson
*Assistant Examiner*—Frank A. LaViola
*Attorney, Agent, or Firm*—Richard C. Litman

[57] ABSTRACT

An apparatus for waving the hair comprises a pair of snap-together complementary pieces made of resilient plastic. The pieces when fitted together define a sinuous or swirled path between them. When the pieces are snapped together over a strand of hair, the strand is held in a sinuous waving shape for imparting a "perm". A first piece includes a cylindrical roller and two partial cylindrical cages, resembling those used in ordinary hair rollers except for their mutual attachment and the angular cut from each cage. The second, mating piece includes one cage and two rollers. In both pieces a cage is tangentially attached to a roller at two places. Each roller or cage on one piece mates to a respective cage or roller on the other piece. The pieces snap together by forcing the middle roller of the first piece between the two rollers of the second piece into the cage of second piece; the two rollers of second piece simultaneously snap into the two cages of the first piece. The assembled apparatus, seen on end, defines three abutting, staggered circles whose axes are laid out as the corners of an isosceles triangle. Each circle is defined by a cage and respective roller concentrically held within it. An entrapped strand of hair winds sinuously about the three cylinders for imparting a wave to the strand.

3 Claims, 1 Drawing Sheet 10
12
20
22
24
A
B
H

HAIR WAVE ROLLERS

FIELD OF THE INVENTION

The present invention relates to devices for imparting a wave to hair for cosmetic purposes.

DESCRIPTION OF THE PRIOR ART

Hair curling devices are in common use. The typical hair curler is a plastic cylinder around which the hair is wound while wet. Means are provided for retaining the hair around the cylinder until it dries, after which the hair is curled. Chemical agents or heat may be applied to the hair to enchance the curl.

A variation employs cylinders which provide their own heat, or which may be heated.

Another type of hair curler is the wand type, in which an elongated metal cylinder or wand is mounted on a handle. The metal wand is electrically heated. Hair is wound repeatedly around the wand.

A clamp is provided to hold the hair in place on the wand. The clamp is an arm pivoted at the joint of the handle and the wand to swing away from the wand or to swing toward it and to lie adjacent the wand. The arm is spring-loaded to lie next to the wand. The are is curved in the plane transverse to its length (and the length of the wand) to cover an arc of about 90 degrees of the wand for clamping the hair.

Several devices known in the prior art are used for imparting waves, rather than curls, to the hair.

One such device is disclosed by Cecil in U.S. Pat. No. 2,910,990. The Cecil invention is a folding pair of hinged discs that closes up like a clam shell to trap hair. A lock of hair is spirally wound inside the device and left to dry. The Cecil device actually tends to make spirals rather than waves.

U.S. Pat. No. 4,151,850 issued to Nathe et al. shows a variation on the heated wand curler. The Nathe device employs doubled parallel cylindrical wands which nest in parallel depressions in a heated metal bed when swung toward the bed about the pivot point. The metal bed surface is sinusoidally convoluted transverse to its length. About one and one-half approximately sine-shaped waves are traced out by the surface: a central mound with a depression (to accept one of the parallel wands) on either side. This invention appears to be difficult to use, and the large heated area is a burn hazard.

Prijic in U. S. Pat. No. 4,739,776, discloses a corrugated (sinusoidally convoluted) tray over which hair is laid. The hair is then held into the troughs of the convolutions by crimp rods; each crimp rod is held in its respective trough by a clip at one end of the crimp rod and a hinge at the other end. The hinge joins that end to the respective trough of the tray. The tray and rods are molded together of plastic with thin bridges as the hinges. Means are provided to join the trays end to end to create longer trays.

The Prijic hair waver suffers from drawbacks caused by the hinge action. The hair will be pushed into each trough in turn by the respective crimp rod. Since the hair near the hinge is pushed into the trough first, adjacent lengths of uncrimped hair lying in the tray will tend to become tangled as the locks differentially pulled into the trough. Also, the long tray is awkward to have hanging from one's head during the hair drying time. The bizarre appearance and bulkiness of the trays when dangling from a user's head make the invention difficult to use while engaging in normal activities, or even very limited activities. The trays of Prijic are less easily covered for public appearance than are the usual hair rollers.

Clingen, in U.S. Pat. No. 4,867,185, shows a plastic hair waving device which acts somewhat similarly to that of Prijic The Clingen device has two generally rectangular halves which fold together along a molded "living" (solid plastic) hinge joining the congruent rectangles, Each rectangle includes slot openings and rounded semi-cylinders, which alternate. The sequence of slots and semi-cylinders on the two halves alternates out of phase so that a semi-cylinder of one half fits into a slot of the other half when the halves are folded together. Hair trapped between the two halves when they are folded is thus forced into a generally sinusoidal pattern for drying. The device is adapted to be joined to another device to make a long waving unit.

The Clingen device suffers from the same drawback as does the Prijic waver because of the folding of the two halves about a hinge line perpendicular to the axes of the semi-cylinders, and because it is also awkard and unsightly to use, for the same reasons.

Gregory, in U.S. Pat. No. 2,490,124, discloses a hair-waving apparatus in which the folding problem of Prijic and Clingen is eliminated. Gregory provides an apparatus consisting of a number of parallel cylindrical "bars" which may be either hollow or soild. The bars are laid side by side with a small gap between each pair of adjoining bars. The bars are held in these positions by U-shaped sheets called "webs" whose two feet are joined to respective adjoining cylindrical bars; each adjoining pair of bars is connected by a web. The whole structure includes enough webs, each contiguous with the next, to hold all of the bars in parallel spaced arrangement.

The Gregory apparatus is molded of flexible plastic. The webs are thin enough that the adjacent bars can be easily forced apart. In use, hair is draped over the bars and a cylindrical rod is placed on the hair covering the gap between the first two bars. The rod is forced into the gap. Because of the resiliency of the webs, the bars spring apart and the rods carry the hair into the U of the web. The bars then spring back together to trap the rod within the U. The hair is thus held in a generally sinusoidal wave for driving.

While solving the problem of differential hair pull caused by folding insertion, the Gregory invention still involves the use of a long, bulky object attached to the head. (If used for waving only the end of a strand of hair, it will be more awkward still.) Also, to snap one of the rods into place will be difficult: insertion of one of the rods requires that one hand hold the rack apparatus in position, while the other holds the rod. There is no easy way to bend the rack to open one of the U's for easy insertion of a rod, while simultaneously keeping the hair in line along the apparatus and holding a different object in each hand.

The Gregory device, and the others, all fail to hold the hair securely within a sinuous path. The Gregory device includes corners wherein the hair may bunch. All of the prior art corrugated wavers includes uncovered convex regions where the hair is unconstrained. At such places a strand of hair may easily escape the sinuous path, and so escape permanent waving.

None of the above inventions and patents, taken either singly or in combination, is seen to describe the instant invention as claimed. Neither is any seen to teach a method of holding the hair between two closely-spaced parallel surfaces, so that the hair cannot bunch up in corners or escape into the surrounding space.

Accordingly, one object of the present invention is a hair waving device which is adapted for easy hair insertion, and which does not hang large bulky objects from the head while the hair is drying.

A further object of the present invention is a device that is adapted to wave only the end of a strand of hair.

Another object is a hair waving device which does not allow strands of hair to come loose from the device, whereby it is prevented from bunching in corners or escaping from the curved path which the device is intended to hold the hair in.

These and other object of the present invention will become readily apparent upon further review of the following specification and drawings.

SUMMARY OF THE INVENTION

The present invention is an apparatus for waving the hair. It comprises a pair of snap-together complementary pieces made of resilient plastic. The pieces when fitted together define a sinuous or swirled path between them. When the pieces are snapped together over a strand of hair, the strand is held in a sinuous waving shape for imparting a "perm". A first piece includes a cylindrical roller and two partial cylindrical cages, resembling those used in ordinary hair rollers except for their mutual attachment and the angular cut from each cage. The second, mating piece includes one cage and two rollers. In both pieces a cage is tangentially attached to a roller at two places. Each roller or cage on one piece mates to a respective cage or roller on the other piece. The pieces snap together by forcing the middle roller of the first piece between the two rollers of the second piece into the cage of second piece; the two rollers of second piece simultaneously snap into the two cages of the first piece. The assembled apparatus, seen on end, defines three abutting, staggered circles whose axes are laid out as the corners of an isosceles triangle. Each circle is defined by a cage and respective roller concentrically held within it. An entrapped strand of hair winds sinuously about the three cylinders for imparting a wave to the strand.

DETAILED DESCRIPTION OF THE PREFERRED EMBODIMENT

Figures 1, 2, 3:
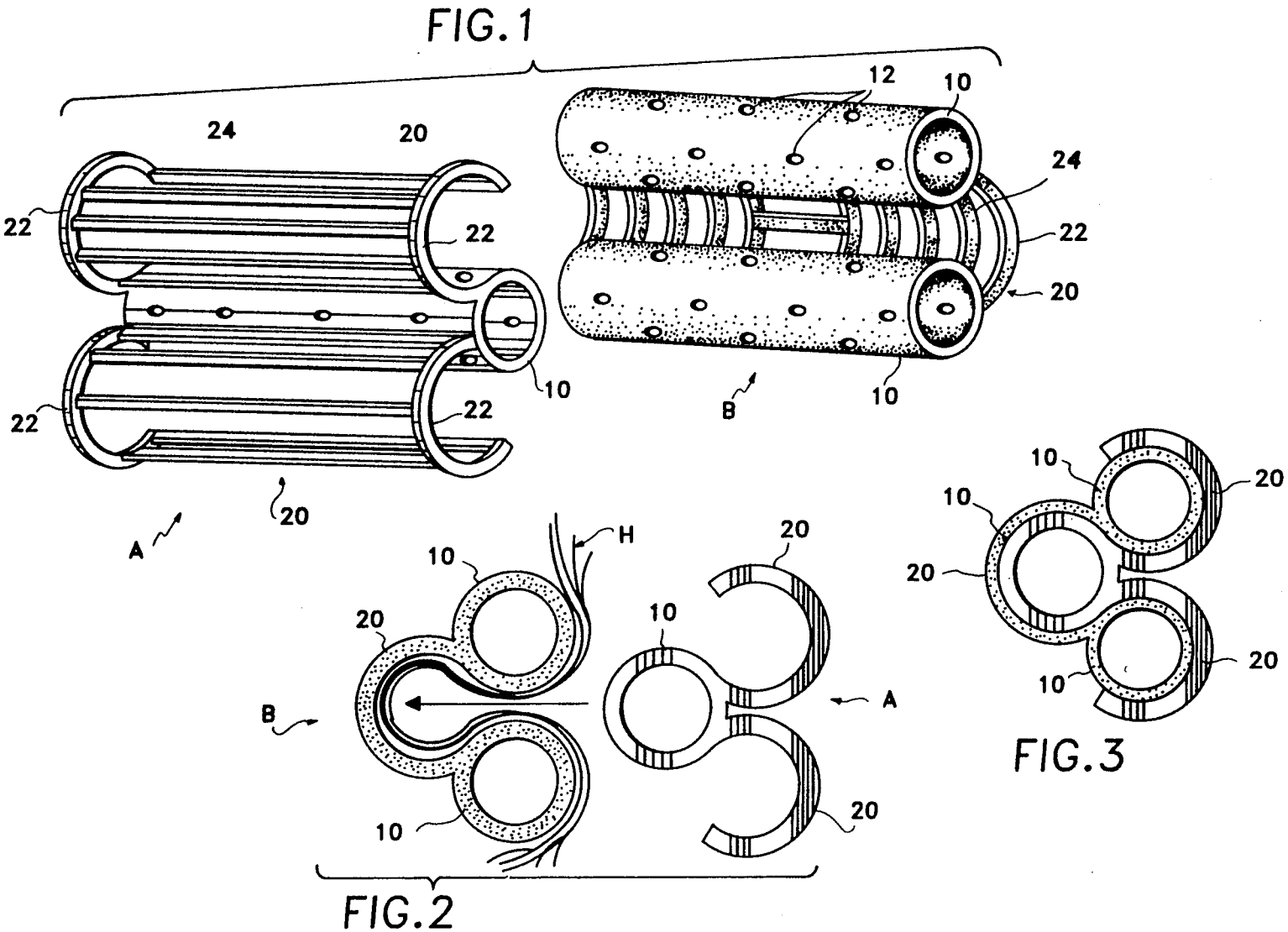
FIG. 1 is a perspective exploded view of the two pieces of the present invention.
FIG. 2 is an exploded end view of the two pieces, showing a strand of hair disposed sinuously along a wave path defined by a space between the pieces when assembled.
FIG. 3 is an end view of the two pieces assembled. Similar reference characters denotes corresponding features consistently throughout the attached drawings.

The present invention is shown in FIG. 1 with the two pieces A and B separated. Each of the pieces A, B includes either one (in the case of A) or two (in B) cylindrical rollers 10 and one (in B) or two (in A) partial cylindrical cages 20. (The term "roller" is borrowed from the typical hair curling device which resembles the part 10; the present invention however involves no rolling). The cage 20 and rollers 10 are tangentially joined. The rollers 10 define complete circles when seen on end; the cages 20 define incomplete circles of about 270°.

Both pieces A and B are preferably made of plastic. The plastic material should be pleasing appearance, flexible and resilient, and able to withstand the heat, moisture, and chemicals that may be used in hair treatment.

Each roller 10 is preferably a hollow cylinder. It may include holes 12 through the cylinder to the inside space for evaporation of moisture from the hair. The cages 20 are preferably open structures, again to encourage evaporation. A mesh, or a series of hoops 22 and bars 24 as pictured may be used. Porous material may also be used.

The rollers 10 and cages 20 of the invention are tangentially joined. That is, when viewed on end so that the cylindrical parts are seen as circles and portions of circles, the circles tangentially touch on their perimeters only. The circles do not overlap as in Olympics symbol; nor are they disjoint. This geometrical relation is seen in FIGS. 2 and 3.

The pieces A and B are used for imparting a wave to a strand of hair H as shown in FIG. 2. The strand of hair H is draped between the pieces A and B they are then forced together. The roller 10 of piece A snaps into the interior of the cage 20 of piece B. Simultaneously, the two rollers 10 of pieces B snap into the cages 20 of piece A. The strand of hair H is trapped between the two pieces A, B and held in the sinuous curve defined by the exterior surface of the rollers 10 and the interior surfaces of the cages 20. This curve is more clearly shown in to FIG. 3, which depicts the assembled or snapped-together unit including the two pieces A, B.

As seen in FIG. 3, the assembled unit defines three staggered circles in end view. Discounting the thickness of the rollers 10 and cages 20, the assembled unit generally resembles three abutting circles whose centers define an isosceles or equilateral triangle.

A great advantage of the present invention over the prior art is the ease with which it can be used, due to its manageable size and number of parts. One hand can easily hold one of the pieces A, B and also hold the hair H draped over the piece in the desired position, The other hand can then be pushed toward the first piece to snap the hair H into place. Several of the units may be used in series to impart waves to a longer strand of hair without the awkwardness of a single large, bulky tray.

Another advantage is the fact that the hair is closely surrounded on all sides by roller or cage, and cannot escape from the sinuous path defined.

It is to be understood that the present invention is not limited to the sole embodiment described above, but encompasses any and all embodiments within the scope of the following claims.

We claim:

1. An apparatus to hold hair in a sinouos path for imparting a wave to the hair held therein, made of resilient material and comprising:

a first roller including a first outer surface defining a first cylinder having a first axis, a length, and a diameter;

a first cage including a straight first attachment edge and a straight first free edge, said first attachment edge parallel to said first free edge, and a first inner surface between said first attachment edge and said first free edge defining an angular portion of a second cylinder having a second axis, said length, and said diameter, said angular portion including an arc more than a straight angle;

a second cage including a straight second attachment edge and a straight second free edge, said second attachment edge parallel to said second free edge, and a second inner surface between said second attachment edge and said second free edge defining an angular portion of a third cylinder having a third axis, said length, and said diameter, said angular portion including said arc;

said first axis, said second axis, said third axis, said first attachment edge, said first free edge, said second attachment edge, and said second free edge all mutually parallel, and said first axis, said second axis, and said third axis disposed in a configuration defining an isosceles triangle;

said first inner surface tangentially joined to said first outer surface along said first attachment edge and said second inner surface tangentially joined to said first outer surface along said second attachment edge, said first attachment edge and said second attachment edge closely adjacent;

said first roller, said first cage, and said second cage together comprising a first piece;

a second roller including a second outer surface defining said second cylinder having said second axis, said length, and said diameter;

a third roller including a third outer surface defining said third cylinder having said third axis, said length, and said diameter;

a third cage including a straight third attachment edge and a straight fourth attachment edge, said third attachment edge parallel to said fouth attachment edge and to said first axis, and a third inner surface between said third attachment edge and said fourth attachment edge defining an angular portion of said second cylinder having said second axis, said length, and said diameter, said angular portion including said arc;

said third inner surface tangentially joined to said second outer surface along said third attachment edge and said third inner surface tangentially joined to said third outer surface along said fourth attachment edge;

said third attachment edge and said fourth attachment edge parallel to said first axis;

said second roller, said third cage, and said third roller together comprising a second piece engaged with said first piece; whereby said sinuous path is created between said first piece and said second piece and the pieces may be separated by a force sufficient to disengage said first piece from said second piece, a strand of hair may then be disposed between said first piece and said second piece, and first piece and said second piece reengaged by another force to hold the strand of hair along said sinuous path for imparting said wave to the strand of hair.

2. The apparatus according to claim 1, including:

openings in the rollers and in the cages for evaporation of moisture from the hair.

3. The apparatus according to claim 1, wherein said isosceles triangle is an equilateral triangle.

* * * * *